US006644385B2

(12) United States Patent
Boissele et al.

(10) Patent No.: US 6,644,385 B2
(45) Date of Patent: Nov. 11, 2003

(54) HEAT EXCHANGER WITH IMPROVED SEALING GASKET, FOR A MOTOR VEHICLE IN PARTICULAR

(75) Inventors: Patrick Boissele, Laval (FR); Dirk Schapeler, Allemagne (DE); Paul Garret, Saint Matrin Du Tertre (FR); Géraud Vatin, Rilhac-Rancon (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/779,444

(22) Filed: Feb. 9, 2001

(65) Prior Publication Data

US 2002/0029874 A1 Mar. 14, 2002

(30) Foreign Application Priority Data

Feb. 10, 2000 (FR) ..... 00 01670

(51) Int. Cl.[7] ..... F28F 9/02

(52) U.S. Cl. ..... 165/79; 165/173; 277/596; 29/890.03; 29/890.052

(58) Field of Search ..... 165/79, 173, DIG. 474; 29/890.03, 890.052; 277/594, 596

(56) References Cited

U.S. PATENT DOCUMENTS

| | | | | | |
|---|---|---|---|---|---|
| 3,597,663 | A | * | 8/1971 | Markarian | 174/52.3 |
| 3,737,169 | A | * | 6/1973 | Glynn | 264/259 |
| 4,224,796 | A | * | 9/1980 | Stiel et al. | 252/67 |
| 4,544,029 | A | * | 10/1985 | Cadars | 165/149 |
| 5,116,558 | A | * | 5/1992 | Wrobel et al. | 264/267 |
| 5,266,978 | A | * | 11/1993 | Kaszmann et al. | 2/446 |
| 5,322,299 | A | * | 6/1994 | Terai | 277/596 |
| 5,654,292 | A | * | 8/1997 | DeLuca et al. | 514/167 |
| 5,681,572 | A | * | 10/1997 | Seare, Jr. | 424/400 |
| 6,020,412 | A | * | 2/2000 | Muschelewicz et al. | 524/296 |
| 6,073,938 | A | * | 6/2000 | Abe et al. | 277/654 |

FOREIGN PATENT DOCUMENTS

| | | |
|---|---|---|
| DE | 2502291 | 7/1976 |
| DE | 4436027 | 4/1996 |
| EP | 0142930 | 5/1985 |
| EP | 0408317 A2 * | 1/1991 |
| FR | 2574177 | 6/1986 |
| FR | 2584488 | 1/1987 |
| JP | 58224298 | 12/1983 |
| JP | 5921994 | 2/1984 |
| JP | 59142392 | 8/1984 |

OTHER PUBLICATIONS

Patent Abstracts of Japan, Pub. No. 59021994, Pub. Date Feb. 4, 1984.
Patent Abstracts of Japan, Pub. No. 59142392, Pub. Date Aug. 15, 1984.
Patent Abstracts of Japan, Pub. No. 58224298, Pub. Date Dec. 26, 1983.

* cited by examiner

*Primary Examiner*—Allen Flanigan
(74) *Attorney, Agent, or Firm*—Liniak, Berenato & White

(57) ABSTRACT

A heat exchanger has a fluid chamber with a peripheral foot, as well as a collector plate with an edge delimiting a groove for a gasket and the peripheral foot. The gasket is formed from a bead of a polymerizable material which is deposited, at a chosen location, on the bottom of the groove, and then polymerized before being compressed by the peripheral foot of the fluid chamber.

18 Claims, 2 Drawing Sheets

HEAT EXCHANGER WITH IMPROVED SEALING GASKET, FOR A MOTOR VEHICLE IN PARTICULAR

FIELD OF THE INVENTION

The invention relates to heat exchangers, especially for motor vehicles, and more particularly to a heat exchanger of the type comprising a fluid chamber equipped with a peripheral foot, as well as a collector plate equipped with a peripheral edge delimiting a peripheral groove which features a bottom and is at least partially able to accommodate the peripheral foot, with a compressible sealing gasket being interposed.

BACKGROUND OF THE INVENTION

A heat exchanger of this type further comprises means for immobilizing the peripheral foot relative to the collector plate, at the same time compressing the sealing gasket. This immobilization is achieved, for example, by a crimping operation.

In a heat exchanger of this type, the sealing gasket has to ensure perfect leaktightness in order to avoid any problem of leakage and of corrosion.

A gasket made of an elastomer material of the rubber type, for example of the EPDM type, is usually used, which is prepared in advance then put in place in the peripheral groove of the collector plate before receiving the peripheral foot of the fluid chamber.

The fitting of such a gasket prepared in advance is a delicate operation since it is necessary for the gasket to be perfectly positioned in the peripheral groove, which is usually U-shaped in profile. However, it may happen that the sealing gasket does not lodge perfectly in the bottom of the peripheral groove, which has the consequence that this gasket is not perfectly compressed after the peripheral foot of the fluid chamber has been put in place. This results in defects in leaktightness which mean that the heat exchanger thus manufactured does not satisfy the checks carried out on leaving the manufacturing line and therefore has to be scrapped.

The object of the invention is especially to surmount the abovementioned drawbacks.

The invention aims, in particular, to obtain a heat exchanger which comprises an improved sealing gasket which is perfectly positioned in the bottom of the peripheral groove and which thus offers perfect leaktightness after the peripheral foot of the fluid chamber has been positioned.

The invention also envisages obtaining a method of manufacturing such a heat exchanger.

SUMMARY OF THE INVENTION

To that end the invention proposes a heat exchanger of the type defined in the introduction, in which the sealing gasket is formed from a bead of a polymerizable material which is deposited, at a chosen location, on the bottom of the peripheral groove and which is then polymerized before being compressed by the peripheral rim of the collector chamber.

Thus the sealing gasket of the invention is formed in situ on the bottom of the peripheral groove from a bead made of polymerizable material, which is then polymerized in situ.

As this bead is deposited directly onto the bottom of the peripheral groove, and at a chosen location on it, the invention makes it possible to deposit the sealing gasket under controlled conditions as regards not only the location where the bead is deposited but also the particular shape of the gasket.

The gasket preferably extends over a height, from the bottom of the peripheral groove, which is greater than its width. It has been observed that, under these conditions, an optimal seal was obtained. The height of the gasket is to be considered from the bottom of the peripheral groove, that is to say in the direction of compression of the gasket.

The gasket may be single and result from the depositing of one bead layer or else be double and result from the depositing of two superimposed bead layers.

In this latter case, the double gasket can be applied either in a single pass or in two successive passes.

The peripheral groove is usually delimited, furthermore, by two sidewalls which extend from the bottom.

According to an important characteristic, the invention also provides for the bead to be deposited on the bottom and at a distance from each of the said sidewalls.

In that way, the gasket is bonded solely to the bottom of the groove and is spaced away from the two sidewalls, without being able to bond to the latter.

This results in the gasket therefore being able to be deformed in an appropriate way during the compression resulting from the peripheral foot being put in place. This deformation takes place optimally with no risk of detaching or tearing of the gasket.

In the invention, the polymerizable material is advantageously based on silicone.

As regards another aspect, the invention relates to a method of manufacturing a heat exchanger of the type defined above, which comprises the following operations:

a) providing a collector plate equipped with a peripheral edge delimiting a peripheral groove featuring a bottom;

b) depositing a bead of a polymerizable material, at a chosen location, on the bottom of the peripheral groove in order to form a sealing gasket;

c) polymerizing the said bead in order to form a polymerized gasket; and d) compressing the polymerized gasket by a peripheral foot of a fluid chamber.

Operation b) is advantageously carried out by a nozzle which is moved above the bottom of the peripheral groove. This movement can be made either manually, or preferably automatically, for example by the use of a template, under controlled conditions.

In operation b), the bead may be deposited either in a single layer in order to form a single gasket, or in two layers in order to form a double gasket.

In all cases, the gasket is preferably applied in a single pass of the nozzle.

According to another characteristic of the invention, in operation b), the bead is deposited on the bottom of the peripheral groove, and at a distance from two sidewalls which are connected to the bottom.

In operation c), polymerization of the gasket is advantageously carried out by application of heat, in order to accelerate the polymerization.

According to yet another characteristic of the invention, the method comprises a subsequent operation e) consisting in immobilizing the peripheral foot of the fluid chamber in the peripheral edge of the collector plate.

BRIEF DESCRIPTION OF THE DRAWINGS

In the description which follows, given solely by way of example, reference is made to the attached drawings in which.

DESCRIPTION OF THE PREFERRED EMBODIMENT

Figure 1:
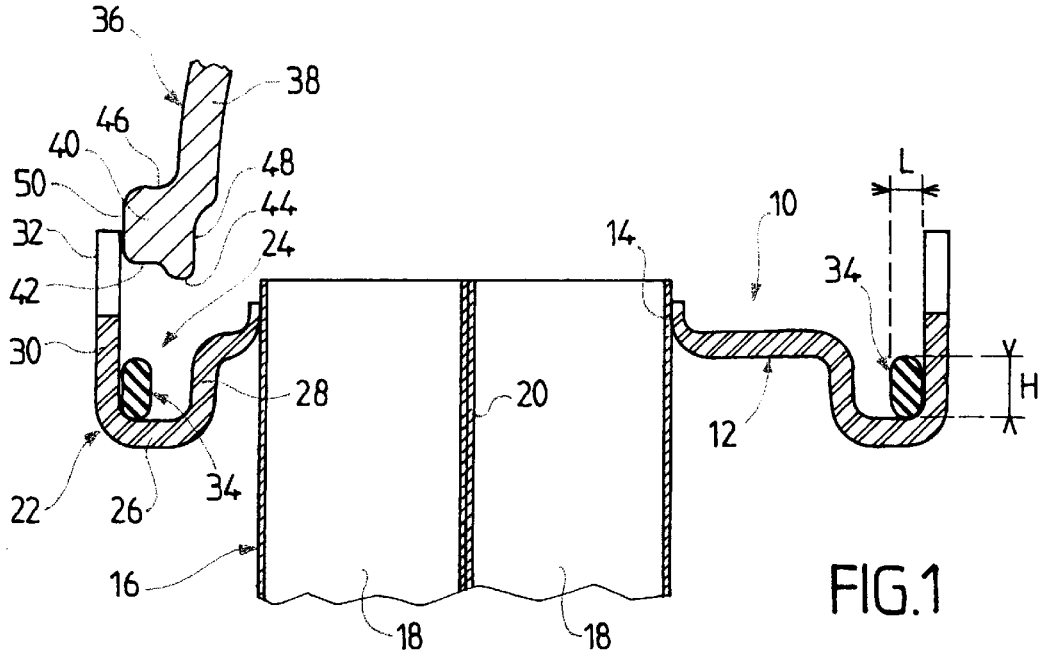
FIG. 1 is a partial view in cross section of a heat exchanger according to the invention, after the gasket has been deposited and before the fluid chamber has been put in place.

In the various figures, like reference numerals refer to like parts.

The heat exchanger represented in FIG. 1 comprises a collector plate 10, also called collector, produced from a stamped metal sheet, preferably based on aluminum. This plate comprises a central web 12, of generally rectangular shape, through which are formed apertures 14 each intended to accommodate the extremity of a tube 16 of a core which is brazed to the collector plate. The tubes 16, in the example, are flat tubes including two internal channels 18 separated by a longitudinal partition 20.

Corrugated spacers (not represented) forming heat-exchange fins are placed between the tubes. The central web 12 is surrounded by a peripheral edge 22 which delimits a peripheral groove 24 having a substantially U-shaped profile. This groove comprises a bottom 26 and two sidewalls: an inner sidewall 28 connected to the web 12 and an outer sidewall 30 the edge of which is castellated so as to define crimping lugs 32 which, initially, are in the extension of the sidewall 30.

On the bottom 26 of the groove is deposited a sealing gasket 34 which is formed in situ from a bead of polymerizable material, as will be seen later on.

The heat exchanger further comprises a fluid chamber 36, partially represented, which comprises a dome-shaped wall 38, bordered by a peripheral foot 40 which features a contour of generally rectangular shape matched to that of the groove 24 so as to be able to be accommodated in the latter while compressing the sealing gasket 34.

The peripheral foot 40 is delimited by a lower face 42 equipped with a peripheral heel 44, by an upper face 46, by an inner side face 48 and finally by an outer side face 50.

As can be seen on the right-hand part of FIG. 1, the gasket 34 possesses a cross section of oblong shape, which has similarities to an oval or to an ellipse, and the height H of which, considered from the bottom 26 (that is to say in the direction of the compression) is greater than its width L. The gasket 34 is arranged on the bottom of the groove and along the outer face 30, without coming into contact with the latter. It will be noted that, in the example represented, the width L is substantially half of the inside width of the groove 24, as delimited between the side faces 28 and 30.

Figure 2:
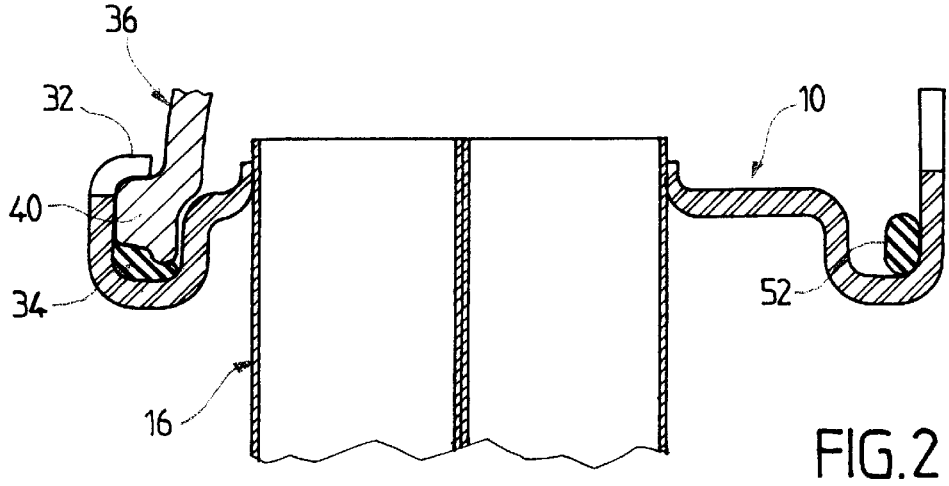
FIG. 2 is a view similar to FIG. 1 after the fluid chamber has been put in place and the gasket compressed.

As will be seen further on, after polymerization of the gasket, the peripheral foot 40 of the fluid chamber is put in place in the groove 24, which compresses the sealing gasket 34 (FIG. 2). The gasket is squeezed and comes to occupy practically the whole width of the groove 24, the compression of the gasket being maximal in the region of the peripheral heel 44 of the peripheral foot 40.

The crimping lugs 32 are folded over onto the upper face 46 of the foot 40 so as to immobilize the peripheral foot relative to the collector plate and to maintain the compression of the gasket, which ensures leaktightness.

The gasket has not been represented in the compressed state on the right-hand part of FIG. 2 for reasons of simplification.

In the embodiment of FIGS. 1 and 2, the gasket is deposited in the form of a single bead, in a single layer, which exhibits an oblong cross section, as indicated above. The sealing gasket of FIGS. 1 and 2 thus results from a deposition in a single layer 52.

Figure 3:
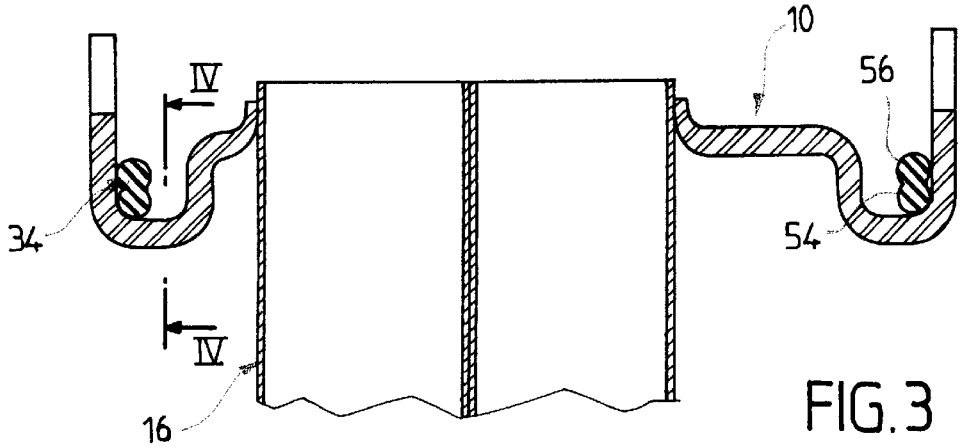
FIG. 3 is a view similar to FIG. 1 with another type of gasket.

In the case of FIG. 3, the gasket results from a successive deposition of two layers, namely a lower layer 54 and an upper layer 56, each layer being formed by a deposition of substantially circular cross section.

Figure 4:
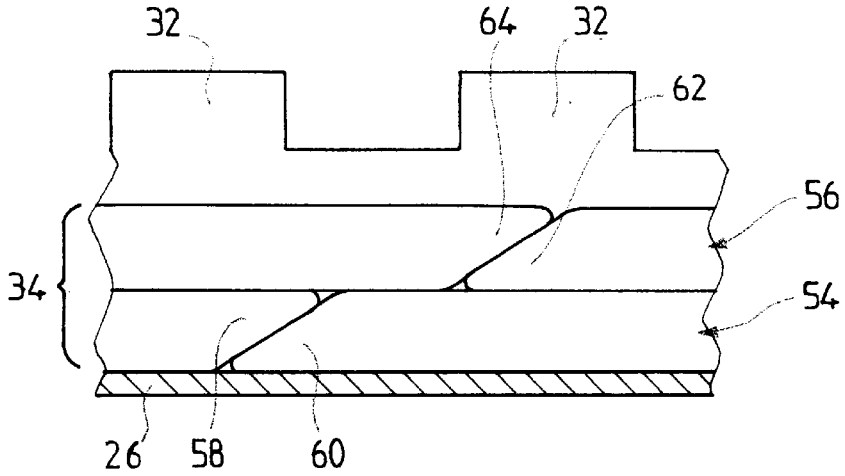
FIG. 4 is a sectional view, on an enlarged scale, along the line IV/IV of FIG. 3.
Figure 5:
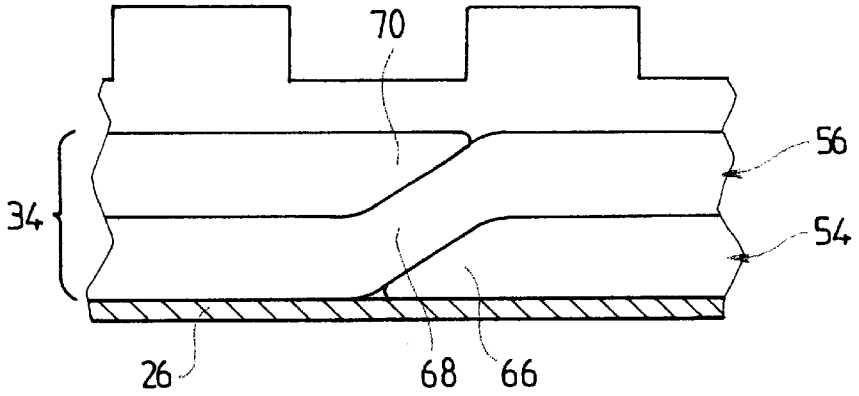
FIG. 5 is a view similar to FIG. 4 in an embodiment variant.

Referring now to FIGS. 4 and 5, two ways are shown of forming the two layers 54 and 56 of the sealing gasket of FIG. 3.

In the case of FIG. 4, the gasket is applied in two successive passes in order first of all to form the layer 54, which exhibits two ends 58 and 60 which come into mutual abutment. Likewise, the layer 56 is formed from a layer the ends 62 and 64 of which abut.

In the case of FIG. 5, the double gasket is applied in a single pass. Starting with one end 66 of the bead, a first layer 54 is formed which is then superimposed, in the region of an intermediate part 68, on top of the end 66, so as to form the second layer 56. The latter terminates in an end 70, situated above the end 66.

In both cases a gasket is produced which, in cross section, exhibits the specific shape shown in FIG. 3.

Figure 6:
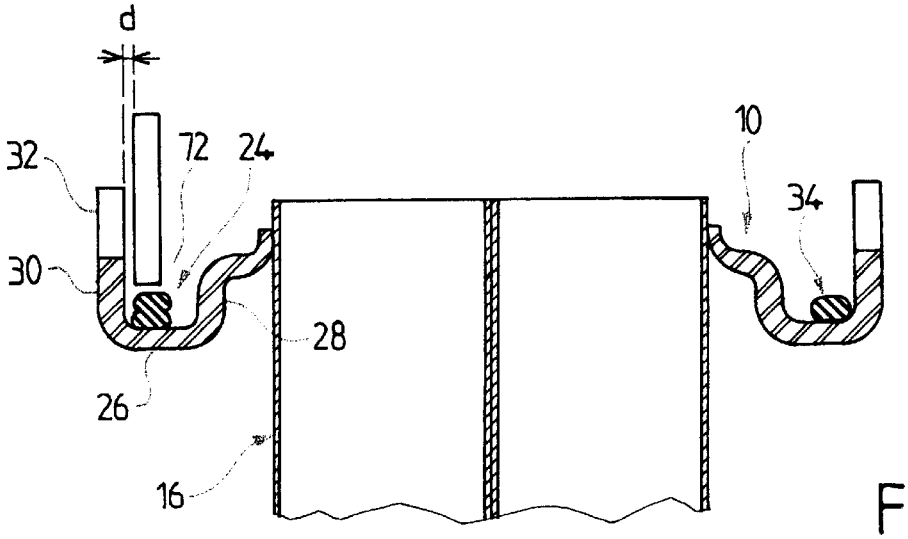
FIG. 6 is a sectional view of a heat exchanger according to the invention, in which a gasket is being deposited by means of a nozzle.

Referring now to FIG. 6, the deposition of a bead of polymerizable material in order to form the sealing gasket is illustrated. This deposition is carried out by means of a nozzle 72 which features a calibrated outlet of a shape chosen in order to extrude the bead of polymerizable material to the required shape. This nozzle is linked to a store of polymerizable material (not represented).

The nozzle 22 is moved manually, or, preferably, automatically, in such a way that the nozzle follows the contour defined by the outer sidewall 30 of the peripheral groove 24. In that way, it is ensured that the gasket is deposited on the bottom 26 of the groove, at the chosen location, without coming into contact either with the outer sidewall 30 or with the inner sidewall 28. It is arranged that the nozzle 72 lies at a chosen distance d from the outer face 30 of the groove. By way of example, this distance may be of the order of 0.5 mm.

In the example shown in FIG. 6, the gasket is deposited in two superimposed layers, but it could also, as a variant, be deposited in a single layer.

After the sealing gasket has been deposited it is polymerized, preferably under the action of heat in order to accelerate the polymerization. This action of the heat can be carried out by any means, for example by passing through an oven. In any event, it is preferable to polymerize the gasket after the bead of polymerizable material has been completely deposited.

The polymerizable material used is advantageously of the silicone type.

Thus a gasket is obtained which, once polymerized, is bonded to the bottom of the peripheral groove, without adhering to the sidewalls thereof.

This makes it possible to move the collector plate with no risk of moving the gasket with respect to the groove.

Moreover, because the gasket is not bonded to the sidewalls of the groove, the gasket does not run the risk of being torn during the compression and/or of working under incorrect conditions.

Thus it is guaranteed that, when the fluid chamber is put in place and when the crimping operation is carried out, the gasket is deformed under optimal conditions guaranteeing leaktightness.

The invention finds a particular application to heat exchangers for a motor vehicle. Such heat exchangers can be traversed either by a fluid for cooling the vehicle engine so as to constitute a radiator for cooling the engine and/or for heating the passenger compartment, or by a gas so as to constitute a supercharging-air cooler.

Such heat exchangers can also be traversed by a refrigerant fluid so as to constitute either a condenser or an evaporator for an air-conditioning circuit.

The invention is not limited to the embodiment examples described, but can be applied to other variants, especially those relating to heat exchangers of mechanical type, that is to say the exchangers in which the fins and/or the collectors are linked mechanically to the tubes.

What we claim is:

1. A heat exchanger comprising:

a fluid chamber equipped with a peripheral foot, and a collector plate equipped with a peripheral edge delimiting a peripheral groove which features a bottom and is at least partially able to accommodate the peripheral foot, with a compressible sealing gasket being interposed, wherein the sealing gasket is formed from a bead of a polymerizable material which is deposited, at a chosen location, on the bottom of the peripheral groove and which is subsequently polymerized before being compressed by the peripheral foot of the fluid chamber, wherein the sealing gasket is double and results from the depositing of two superimposed layers of the bead applied in a single pass.

2. The heat exchanger of claim 1, wherein the sealing gasket extends over a height, from the bottom of the peripheral groove, which is greater than its width.

3. The heat exchanger of claim 1, wherein the sealing gasket is single and results from the depositing of one bead layer.

4. The heat exchanger of claim 1, wherein the sealing gasket is double and results from the depositing of two superimposed layers of the bead.

5. The heat exchanger of claim 4, wherein the double gasket is applied in a single pass.

6. The heat exchanger of claim 4, wherein the double gasket is applied in two successive passes.

7. A heat exchanger, comprising: a fluid chamber equipped with a peripheral foot; and a collector plate equipped with a peripheral edge delimiting a peripheral groove which features a bottom and is at least partially able to accommodate the peripheral foot, with a compressible sealing gasket being interposed, wherein the sealing gasket is formed from a bead of a polymerizable material which is deposited, at a chosen location, on the bottom of the peripheral groove and which is subsequently polymerized before being compressed by the peripheral foot of the fluid chamber; said peripheral groove being delimited by two sidewalls which extend from the bottom, and the bead which forms the sealing gasket is deposited on the bottom and at a distance from each of said sidewalls.

8. The heat exchanger of claim 1, wherein the polymerizable material is based on silicone.

9. A heat exchanger, comprising:

a fluid chamber equipped with a peripheral foot, and a collector plate equipped with a peripheral edge delimiting a peripheral groove which features a bottom and is at least partially able to accommodate the peripheral foot, with a compressible sealing gasket being interposed, wherein the sealing gasket is formed from a bead of a polymerizable material in a non-liquid state capable of maintaining a specific shape which is deposited, at a chosen location, on the bottom of the peripheral groove and which is subsequently polymerized before being compressed by the peripheral foot of the fluid chamber, wherein the sealing gasket is double and results from the depositing of two superimposed layers of the bead.

10. A heat exchanger comprising:

a fluid chamber equipped with a peripheral foot, and a collector plate equipped with a peripheral edge delimiting a peripheral groove which features a bottom and is at least partially able to accommodate the peripheral foot, with a compressible sealing gasket being interposed, wherein the sealing gasket is formed from a bead of a polymerizable material which is deposited, at a chosen location, on the bottom of the peripheral groove and which is subsequently polymerized before being compressed by the peripheral foot of the fluid chamber, wherein the sealing gasket is double and results from the depositing of two superimposed layers of the bead, wherein the double gasket is applied in a single pass.

11. The heat exchanger of claim 9, wherein the double gasket is applied in two successive passes.

12. A method of manufacturing a heat exchanger, comprising a fluid chamber equipped with a peripheral foot, and a collector plate equipped with a peripheral edge delimiting a peripheral groove which features a bottom and is at least partially able to accommodate the peripheral foot, with a compressible sealing gasket being interposed, wherein the sealing gasket is formed from a double bead of a polymerizable material which is deposited, at a chosen location, on the bottom of the peripheral groove and which is then polymerized before being compressed by the peripheral foot of the fluid chamber, the method comprising the following operations:

providing the collector plate equipped with said peripheral edge delimiting said peripheral groove featuring said bottom;

depositing said double bead of said polymerizable material, at said chosen location, on said bottom of said peripheral groove in order to form said sealing gasket;

polymerizing said double bead in order to form a polymerized sealing gasket; and compressing said polymerized gasket by said peripheral foot of said fluid chamber.

13. The heat exchanger of claim 7, wherein said sealing gasket is single and is formed by depositing said sealing gasket in a single pass.

14. The heat exchanger of claim 7, wherein said sealing gasket is double and is formed from depositing said sealing gasket in two superimposed layers of said bead.

15. The heat exchanger of claim 14, wherein the double gasket is applied in a single pass.

16. The heat exchanger of claim 14, wherein the double gasket is applied in two successive passes.

17. The heat exchanger of claim 7, wherein the sealing gasket extends over a height, from the bottom of the peripheral groove, which is greater than a width.

18. The heat exchanger of claim 7, wherein said polymerizable material is silicone based.

* * * * *